US006221213B1

(12) United States Patent
Cadek

(10) Patent No.: US 6,221,213 B1
(45) **Date of Patent: *Apr. 24, 2001**

(54) PROCESS AND DEVICE FOR MEASURING SLICE GAP SPACING AT A PAPER MACHINE HEADBOX

(75) Inventor: Walter Cadek, Graz (AT)

(73) Assignee: Andritz-Patentverwaltungs-Gesellschaft m.b.H., Graz (AT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/969,691

(22) Filed: Nov. 13, 1997

(30) Foreign Application Priority Data

Nov. 13, 1996 (AU) ..... 1985/96

(51) Int. Cl.[7] ..... D21F 1/06; D21F 7/06; D21F 1/02

(52) U.S. Cl. ..... 162/198; 162/259; 162/263

(58) Field of Search ..... 162/198, 212, 162/254, 50, 259, 262, 263, 336, 344, 346; 33/561; 364/471.01, 471.02

(56) References Cited

U.S. PATENT DOCUMENTS

| | | | | |
|---|---|---|---|---|
| 3,828,248 | * | 8/1974 | Wennerberg | 324/34 TK |
| 3,994,773 | * | 11/1976 | Wolf et al. | 162/259 |
| 4,539,073 | * | 9/1985 | Andersson | 162/198 |
| 4,791,367 | * | 12/1988 | Typpo | 324/229 |
| 4,929,895 | * | 5/1990 | Typpo | 324/231 |

* cited by examiner

*Primary Examiner*—Steve Alvo
(74) *Attorney, Agent, or Firm*—Alix, Yale & Ristas, LLP

(57) ABSTRACT

The invention refers to a process for measuring spacing at a paper machine headbox. It is primarily characterized by constant magnetic fields being generated at the headbox slice gap area, the intensity of these fields being measured and these measurements being used to determine the gap between the individual lips. The invention also refers to a measuring device to determine spacing in the headbox 1 area of a paper machine, where a magnetic field generator 10 for a constant magnetic field is provided in one of the two elements 11 that determine the gap and a measuring device for magnetic fields 9 is contained in the second of the two elements 7, 8 determining the gap.

14 Claims, 3 Drawing Sheets

PROCESS AND DEVICE FOR MEASURING SLICE GAP SPACING AT A PAPER MACHINE HEADBOX

BACKGROUND OF THE INVENTION

The present invention relates to a process and a device for measuring spacing at a paper machine headbox.

The water content and thus, the consistency of the pulp mixture in the headbox of a paper machine are normally set at the headbox feed by altering the slice gap. In a multi-layer headbox, measuring the slice gap is even more important because it means that dewatering behavior in the wire section can be controlled even more efficiently for multi-layer operations. The following methods of measuring, all of which take measurements indirectly because of the prevailing difficulties, are already known for the tissue machine: (a) measuring at the lip adjustment drive, without taking account of any deformation of the thin lips, which are subject to enormous loads because of the high pressures in the headbox, and (b) measuring using thin, mechanical levers which either relay the position of the lip back out of the slice gap area or through the side wall to the outside. These levers are complicated to install and the results of measurements taken correspondingly unreliable.

SUMMARY OF THE INVENTION

The object of the invention is to provide a measuring method which measures the slice gap with the greatest possible accuracy.

The invention is thus characterized by constant magnetic fields being generated at the headbox slice gap area, the intensity of these fields being measured and these measurements being used to determine the gap between the individual lips. In this way, the consistencies in the constant part to the paper machine can be determined exactly, thus fulfilling the requirements for exact control of a multi-layer headbox (top layer, intermediate layer, back layer). The pulp quantities in the individual layers can be set precisely at the headbox area.

An advantageous further development of the invention is characterized by the magnetic field being generated by a permanent magnet. With this arrangement, stainless steel walls can also be penetrated without the magnetic field being affected. This penetration is particularly important because the lips must be smooth, i.e., not have any irregularities, on the side facing the pulp. Thus the measurement can be taken through this uniform layer. Conventional inductive gap sensors or even eddy current sensors cannot penetrate through stainless steel walls.

A favorable configuration of the invention is characterized by a Hall generator being used to measure the magnetic field. These are particularly suitable for installation in the thin lips because of their small physical dimensions.

A favorable further development of the invention is characterized by connecting non-linear electrical elements to the signal output of the magnetic field sensor in order to linearize the measuring result. These non-linear elements have a non-linear characteristic curve which is inverse to the characteristic curve of the magnetic field. Thus, where is no need to linearize the magnetic field.

An advantageous configuration of the invention is characterized by non-linear signals from a transducer being converted into a linear signal using a data table. This data table can be adapted very easily to the appropriate characteristic curve of the magnetic field. Any non-linearity from the Hall generator or the signal processing can also be taken into account in this way.

An alternative configuration of the invention is characterized by non-linear signals from a transducer being converted using a data table into a signal which is an intended non-linear signal. One of the advantages of this is that small gaps can be measured with greater accuracy and larger gaps with less accuracy. The relative accuracy (resolution/current signal level) could be kept at a constant level, for example, over the entire measuring range.

The invention also refers to a measuring device to determine spacing in the headbox area of a paper machine. It is characterized by a magnetic field generator for a constant magnetic field being provided in one of the two elements that determine the gap and a measuring device for magnetic fields being contained in the second of the two elements determining the gap. This type of measuring equipment is particularly easy to install in the thin lips of a headbox.

A favorable further development of the invention is characterized by a permanent magnet being provided as the source of the magnetic field; as an alternative, a current coil can also be provided. The permanent magnet can operate without an electrical supply voltage and, therefore, does not require any type of cable connection to the remaining parts of the measuring set-up. A current coil can generate a particularly strong magnetic field which is constant, even at extreme temperature fluctuations.

An advantageous configuration of the invention is characterized by a Hall generator being provided as a device to measure magnetic fields. This is particularly easy to accommodate in the headbox lips thanks to its small physical dimensions.

An advantageous further development of the invention is characterized by the source of the magnetic field, particularly the permanent magnet, being located in the center lip of a two-layer headbox with center lip, and a measuring device for magnetic fields being placed in each outer lip (top and bottom). Thus, the gaps between the top and the center lip and between the center and the bottom lip can be measured particularly well.

A particularly favorable further development of the invention for a multi-layer headbox with several intermediate lips is characterized by the sources of the magnetic fields, particularly the permanent magnets, being installed in an offset arrangement in the intermediate lips of a multi-layer headbox and one pair of magnetic field measuring devices being provided for each magnetic field and placed in each outer lip (top and bottom). With this offset arrangement, the position of the individual intermediate lips between the top and bottom lips can be determined exactly, and thus, the gap between the intermediate lips can be calculated from the differences in the spacing. In this way, all of the gaps are registered in order to determine the individual material flows.

An advantageous configuration of the invention is characterized by the magnets being arranged such that they generate a linear magnetic field. The signal from the magnetic field detectors can then be used as a measuring signal without any further processing.

A favorable further development is characterized by the magnetic field measuring devices being connected to a microprocessor. In this way, the signals from the measuring transducer can be converted in a particularly favorable manner into the linear or non-linear signals required for further processing.

BRIEF DESCRIPTION OF THE DRAWINGS

The invention will now be explained using examples based on the drawings, in which.

DESCRIPTION OF THE PREFERRED EMBODIMENT

Figure 1:
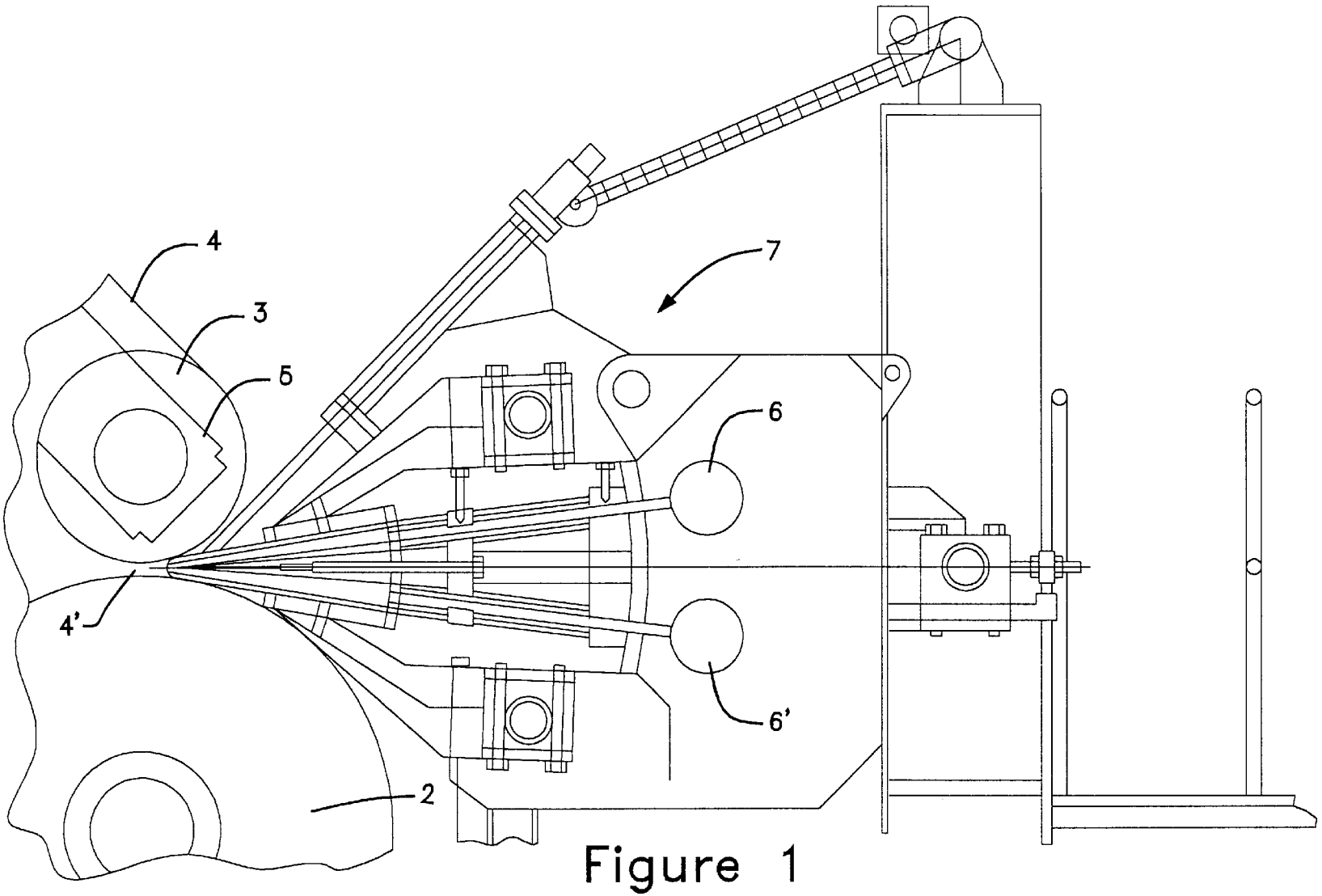
FIG. 1 shows a section through a two-layer headbox for a tissue machine.

In FIG. 1, a two-layer headbox 1 for a tissue machine is shown. The paper web is formed here between two rolls 2, 3, which have wire cloths 4,4'. There is a gap 5 between these wires 4,4' running over the rolls 2,3 and the suspension supplied to the headbox 1 through feed pipes 6,6' is injected through nozzles into this gap 5. The speed of the wires 4,4' and thus, the required speed of the suspension injected into the gap 5 can be up to approximately 2000 m/min.

Figure 2:
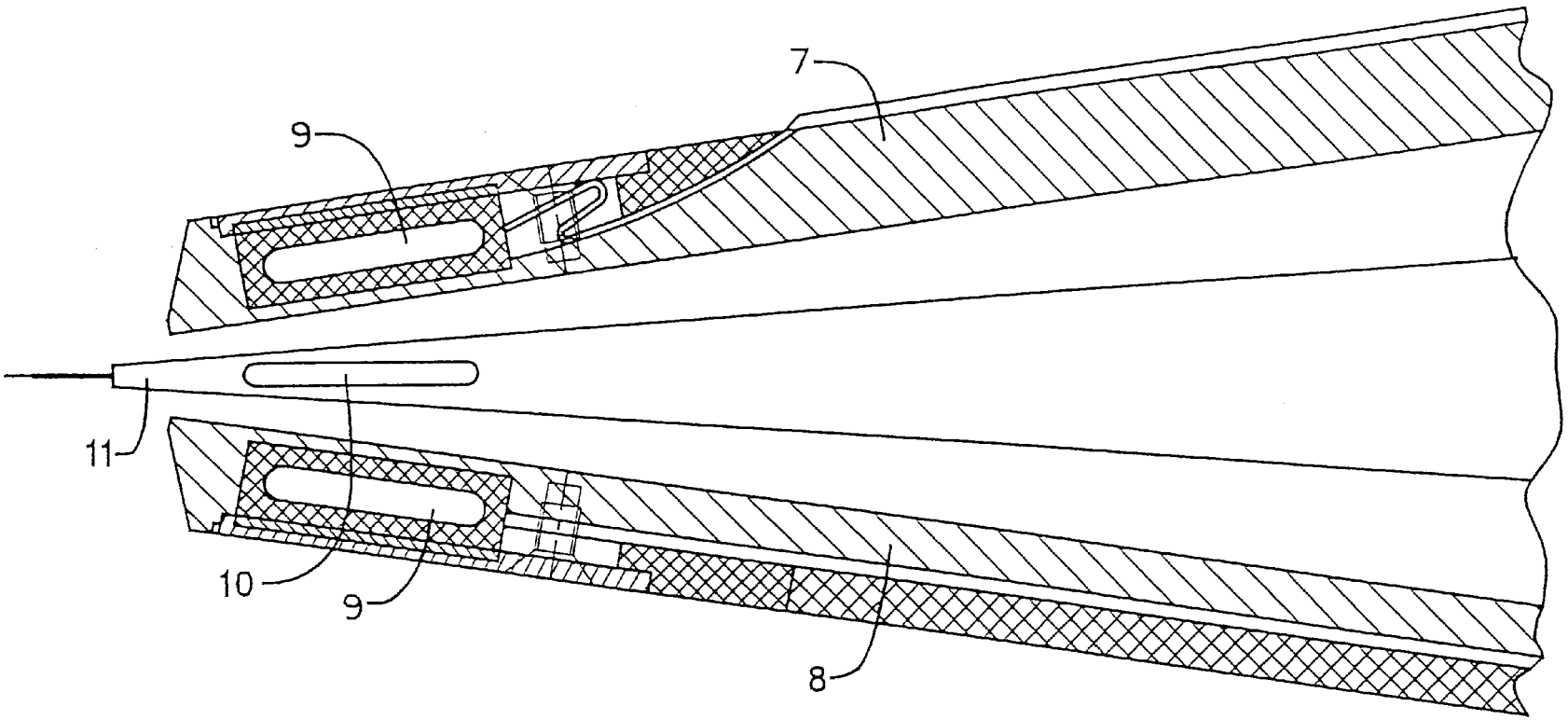
FIG. 2 illustrates the lips with built-in measuring equipment in a detailed drawing.

The area over which the suspension enters into the gap 5 between the wires 4,4' on the rolls 2,3 is shown in the detailed drawing in FIG. 2. A magnetic field receiver 9 is installed in the moveable top lip 7 and moveable bottom lip 8, respectively, and a magnetic field transmitter 10 is installed in the intermediate lip 11. The transmitter 10 generates a reference magnetic field of constant intensity, which depending on the lip material, can be influenced by the movement of lip 7 or 8. The intensity of the transmitter's 10 magnetic field depends on the measurement position within the field. The signal from the magnetic field receiver 9 corresponds to the magnetic field received and thus, also depends on the position, particularly the distance separating it and the magnetic field transmitter 10. As a result, the signal from the magnetic field receiver 9 is commensurate with, and can be used as a measure of, the distance separating the intermediate lip 11 and the top lip 7 or bottom lip 8. As a general rule, there is normally no linear connection between the distance separating the transmitter 10 and the receiver 9, however, there is a clear relationship in that a certain signal corresponds to a certain intensity of magnetic field and thus, to a certain distance.

Taking account of this special characteristic, where the intensity of the magnetic field depends on its location, a subsequent microprocessor (not shown) can be used to linearize the characteristic curves. This linearization generates, for example, a value for the actual spacing by means of a data table, using the magnetic field receiver signal in each case. The output can take the form of a display or also a normalized current signal, e.g., 4 . . . 20 mA. The current signal is particularly suitable for further processing in a process control system.

Figure 3:
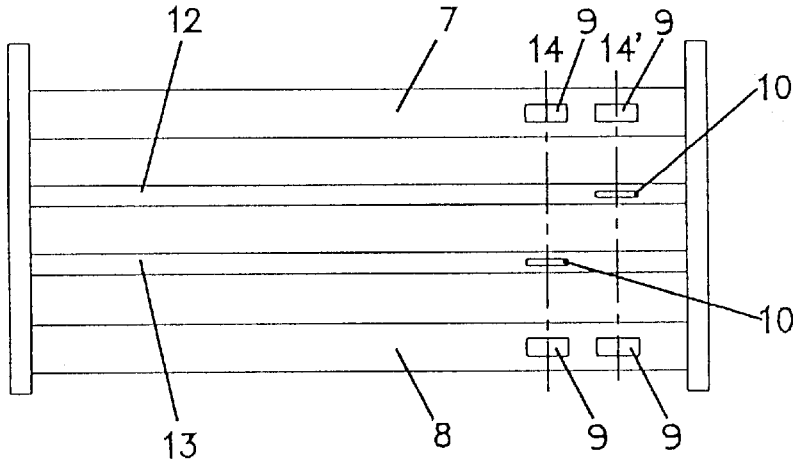
FIG. 3 shows how this equipment is installed in a three-layer headbox.

FIG. 3 shows a view from the wire section looking towards the lips in a three-layer headbox. In order to measure the position of two intermediate lips 12, 13, two measuring arrangement set-ups are installed adjacent to one another, but with sufficient space in between to prevent the signals from interfering with one another. The measuring arrangement 14 on the left measures the position of the lower intermediate lip 13 and the measuring arrangement 14' on the right measures the position of the upper intermediate lip 12. These signals can also be used to determine the space between the two intermediate lips 12, 13 from the difference calculated. The measuring arrangements 14, 14' are structured in the same way as the measuring arrangements for a two-layer headbox and each comprises two magnetic field receivers 9 and one transmitter 10.

Figure 4:
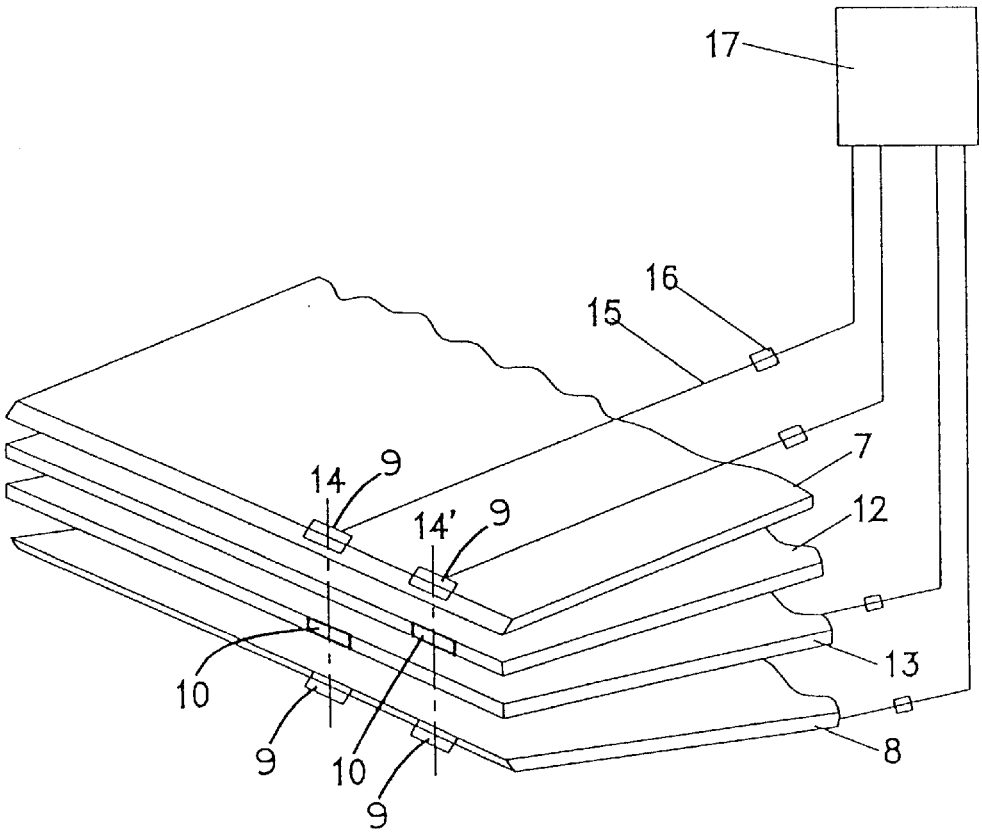
FIG. 4 provides a perspective view of FIG.3.

FIG. 4 shows a perspective of lips 7, 8, 12, 13 and of the built-in in measuring arrangements 14, 14' for a three-layer headbox. If the transmitters 10 are permanent magnets, no electrical connection to a power source is required. The receivers 9 are electrically connected via conductors 15 to non-linear electrical elements 16, for linearizing the receiver output signals. A microprocessor based display unit 17 generates a visual indication of the gaps, and can deliver gap width data to a controller (not shown). In an alternative embodiment, linearization can be achieved by a "look up" data table or other digital techniques, in unit 17.

If the gap between the individual headbox lips is to be determined across the running direction of the web in order to take account of lip deflection, several measuring arrangements can also be installed across the web width. This is possible both in a two-layer and in a three-layer headbox.

What is claimed is:

1. Process for measurement of a variable slice gap spacing between two relatively adjustable lip elements located at a fixed position in a paper machine headbox to guide a flowing pulp slurry, comprising generating a constant magnetic field using a generator entirely from within one of said lip elements at the slice gap and measuring the field intensity with a measuring device entirely within the other of said lip elements to determine the gap between the lip elements.

2. Process according to claim 1, wherein the magnetic field is generated by a permanent magnet.

3. Process according to claim 1, wherein the field is measured by a Hall generator.

4. Process according to claim 1, wherein linearization of the measuring result is achieved by connecting non-linear electrical elements to the signal output of the magnetic field sensor and by these non-linear elements having a non-linear characteristic curve which is inverse to the characteristic curve of the magnetic field.

5. Process according claim 1, wherein non-linear signals from a field measuring transducer are converted into linear signals using a data table.

6. Process according to claim 1, wherein non-linear signals from a field measuring transducer are converted into non-linear signals using a data table.

7. Measuring device to determine gap spacing defined between two relatively adjustable lip elements located at a fixed position in the headbox area of a paper machine to guide a flowing pulp slurry, comprising a magnetic field generator for generating a constant magnetic field, said generator being contained entirely within one of two elements that define the gap, and a measuring device for magnetic fields, said measuring device being contained entirely within the second of the two elements that define the gap.

8. Measuring device according to claim 7, wherein a permanent magnet (10) is provided to generate the magnetic field.

9. Measuring device according to claim 7, wherein a current coil is provided to generate the magnetic field.

10. Measuring device according to claim 7, wherein a Hall generator (9) is provided as the device to measure the magnetic fields.

11. Measuring device according to claim 7, wherein the generator of the magnetic field (10), is a permanent magnet located in the center lip (11) of a two-layer headbox (1) and the measuring device (9) for magnetic fields is placed in each outer lip (7) and (8).

12. Measuring device according to claim 7, wherein a plurality of the magnetic field generator (10), in the form of permanent magnets, are installed in an offset arrangement in the intermediate lips (12,13) of a multi-layer headbox (1) with several intermediate lips (12,13) and one pair of magnetic field measuring devices (9) being provided for each magnetic field and placed in each outer lip (7) and (8).

13. Measuring device according to claim 7, wherein the magnet field measuring devices (10) are arranged such that they generate a linear magnetic field.

14. Measuring device according to claim 7, wherein the magnetic field measuring devices (9) are connected to a micro-processor.

* * * * *